US006314123B1

(12) United States Patent
Burgmann et al.

(10) Patent No.: US 6,314,123 B1
(45) Date of Patent: Nov. 6, 2001

(54) METHOD FOR CONTINUOUS SMELTING OF SOLID METAL PRODUCTS

(75) Inventors: Wilhelm Burgmann, Yutz (FR); Jean Monai, Petange (LU); Jean-Luc Roth, Hettange-Grande (FR); Henri Radoux, Bereldange (LU)

(73) Assignee: Paul Wurth S.A., Grand Duchy (LU)

( * ) Notice: Subject to any disclaimer, the term of this patent is extended or adjusted under 35 U.S.C. 154(b) by 0 days.

(21) Appl. No.: 09/529,592

(22) PCT Filed: Sep. 24, 1998

(86) PCT No.: PCT/EP98/06091

§ 371 Date: Sep. 25, 2000

§ 102(e) Date: Sep. 25, 2000

(87) PCT Pub. No.: WO99/20802

PCT Pub. Date: Apr. 29, 1999

(30) Foreign Application Priority Data

Oct. 17, 1997 (DE) ..... 90154

(51) Int. Cl.[7] ..... F27D 13/00

(52) U.S. Cl. ..... 373/80; 373/43

(58) Field of Search ..... 373/60, 71, 80, 373/84, 85, 68, 42, 43; 75/10.39, 10.41, 10.42, 10.66, 10.3, 10.48, 385, 501, 512, 532, 555, 535, 529, 543, 571, 581, 508, 509, 467; 266/201, 207, 217, 237; 588/251, 246

(56) References Cited

U.S. PATENT DOCUMENTS 3,663,207 * 5/1972 Themelis et al. ..... 75/696
3,912,501 * 10/1975 De Castejon ..... 75/10.34
4,025,059 5/1977 Steinmetz et al. .
4,052,197 * 10/1977 Brotzmann et al. ..... 75/385
4,214,898 * 7/1980 Iwanami et al. ..... 75/10.41
4,545,786 * 10/1985 Tanoue et al. ..... 48/92
4,676,825 * 6/1987 Sironi ..... 75/467
4,772,317 * 9/1988 Rommerswinkel ..... 75/543
5,500,870 3/1996 König et al. .

FOREIGN PATENT DOCUMENTS 1224340 9/1966 (DE) .
3732939 4/1989 (DE) .
0653496 5/1995 (EP) .
1482929 8/1967 (FR) .

* cited by examiner

*Primary Examiner*—Tu Ba Hoang
(74) *Attorney, Agent, or Firm*—Smith, Gambrell & Russell, LLP

(57) ABSTRACT

The invention concerns a method for continuous smelting of solid metal products in a reactor comprising a smelting zone and a metallurgical processing zone, which consists in continuously heating the solid metal products in the smelting zone, gradually transferring said smelted products into the metallurgical process zone, refining the smelted products in the metallurgical process zone in an oxidising slag medium, separating the metallurgical process zone slag from the smelting zone slag, transforming the oxidising slag in the metallurgical process zone into a reducing slag, desulphurizing the smelted products in the metallurgical processing zone in a reducing slag medium and casting the smelted metal.

19 Claims, 2 Drawing Sheets

METHOD FOR CONTINUOUS SMELTING OF SOLID METAL PRODUCTS

Figure 1:
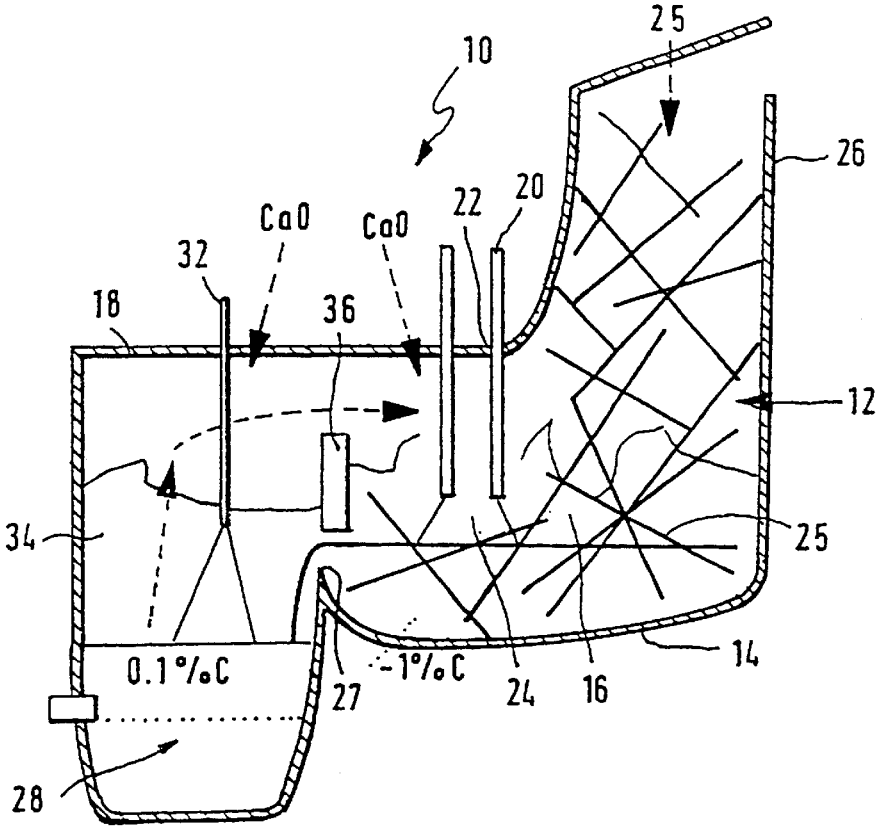

The present invention relates to a method for the continuous melting of solid metallic products.

The method relates more particularly to the melting of metallic solids such as solid iron, solid pig iron, scrap iron or pig iron, pre-reduced products etc., which are used, possibly with the addition of liquid pig iron for example, for the production of steel. The method can be implemented inside a reactor comprising for example an electric furnace, in which the energy required for the melting is produced by an electric arc and/or by a gas-fired, oil-fired or coal-fired furnace and/or by a plasma torch furnace.

The continuous melting of solid products is generally carried out in a reactor comprising two adjacent zones, namely a melting zone and a metallurgical treatment zone. The solid products are loaded into the melting zone of the reactor and are then melted under the effect of a considerable input of energy. The metal thus melted is progressively transferred into the second zone and undergoes a metallurgical treatment there with the aim of adjusting its chemical composition. This metallurgical treatment generally comprises a refining of the liquid metal during which a refining gas, such as oxygen for example, is injected into the metal bath using a lance in order to reduce the carbon and silicon content of the steel produced. Such a method is described, for example, in the French patent application FR-A-1,482,929.

However, apart from carbon and silicon, the molten metal contains other impurities which have deleterious effects on the physical and mechanical properties of the steel produced. Among these impurities particular mention may be made of sulphur which, inter alia, reduces the impact strength of the steel, its fatigue strength, its corrosion resistance and its weldability.

Unfortunately, the sulphur cannot be eliminated at the same time as the carbon since desulphurisation requires very different operating conditions from decarburisation.

In fact, during decarburisation, a slag is present which is oxidising because of the insufflation of large quantities of oxygen. Desulphurisation, however, becomes more efficient when the slag is a reducing slag.

In the refining zone of furnaces such as those described in the French patent application FR-A-1,482,929, the conditions are such that barely 30% of the sulphur contained initially in the metal charge loaded into the furnace is eliminated. This means that it is always necessary to carry out a secondary metallurgical treatment in a receptacle placed downstream from the fusion reactor, for example a ladle furnace.

The object of the present invention is therefore to propose a method for the continuous melting of solid metallic products which permits not only a reduction in carbon content but also a reduction in the sulphur content of the molten metal.

In conformity with the invention, this objective is attained by a method for the continuous melting of solid metallic products in a reactor with two separate zones, a melting zone and a metallurgical treatment zone, which comprises steps consisting in a) continuously heating the solid metallic products in the melting zone until the solid products melt, b) progressively transferring the melted products into the metallurgical treatment zone, c) refining the melted products in the metallurgical treatment zone in an environment comprising an oxidising slag, d) separating the slag of the metallurgical treatment zone from the slag of the melting zone, e) converting the oxidising slag in the metallurgical treatment zone into a reducing slag, f) desulphurising the melted products in the metallurgical treatment zone in an environment comprising a reducing slag, g) pouring the molten metal.

The solid metal is melted continuously in the melting zone. An oxidising slag is present in this zone, which enables a large proportion of the phosphorus contained in the molten metal to be eliminated. In fact, the phosphorus, which, inter alia, reduces the ductility and the weldability of the steel, is transferred to the oxidising slag by an exchange reaction with this slag. As its melting progresses, the molten metal is transferred to the second zone, in which the metallurgical treatment proper occurs.

After arrival in the second zone, the metallurgical treatment of the molten metal takes place in two stages. In the first stage, the main process is a reduction of the carbon and silicon contents of the metallic bath under oxidising conditions. This refining is achieved by oxygen injection into the metallic bath and by the addition of, for example, CaO in order to form the slag. The carbon and silicon contents of the metallic bath may be reduced in this way to predetermined values, preferably lying between 0.05% and 0.1% for carbon.

After this oxidising refining, the conditions in the treatment zone are modified in order to change from an oxidising environment to a reducing environment. Such a transformation of conditions is achieved by an addition of aluminium Al and/or of silicon Si and/or of carbon C to the slag. The slag is thus killed and changes from a more oxidising slag into a more reducing slag. It should be noted that the silicon and/or the carbon are added in such a way as not once again to increase their concentrations in the metallic bath, which would diminish the effect of the earlier refining, but in such a way as to reduce only the FeO in the slag and to lower the oxygen content in the metal.

Under the reducing conditions created in this way, the second stage of the metallurgical treatment is then carried out, i.e. the desulphurisation of the metallic bath. During this desulphurisation, the metallic bath is preferably stirred by bubbling an inert gas, argon for example, through it in order to facilitate the exchange between the metallic bath and the slag. Since the slag is a reducing agent, a large proportion of the sulphur passes into the slag.

Under these conditions, a desulphurisation of more than 80% becomes possible and, depending on the sulphur content of the solid products and the quantity of slag involved, final sulphur contents of 0.010% are achieved in the steel poured from the second zone of the reactor.

The proposed method thus makes possible the production of steel with low carbon and sulphur contents in a two-zone reactor and hence makes it possible to avoid ladle furnace treatment in the mass production of steels, such as that of rods for reinforced concrete, for which a sulphur content of between 0.020% and 0.030% is aimed at in the finished product.

For new electric steel plants producing high quality steels with substitutes for scrap iron which enable low copper contents to be achieved (pig iron, pre-reduced products, iron carbide), low-sulphur steels (less than 0.010% of sulphur in the finished product) are difficult to produce in an electric steel plant: in fact, the oxidising conditions in an electric furnace do not allow desulphurisation by more than 30%, i.e. a maximum of 30% of the sulphur loaded into the furnace is eliminated. However, apart from desulphurised pig iron, substitutes for scrap iron contain much more sulphur than the pure scrap iron that they replace: 0.020% S to 0.100% S for pre-reduced products (DRI) depending on their source and 0.050% to 0.100% S for the non-desulphurised pig iron. With massive use of a substitute containing more than 0.030% S, it is impossible to attain the objective of less than 0.020% S in the pouring from a conventional electric furnace. The present method, which enables a more efficient desulphurisation to be achieved, is therefore an important benefit when envisaging the massive use of pre-reduced products or non-desulphurised pig iron as a substitute for the scrap iron. This method thus widens the range of raw materials usable for the production in the electric furnace of high-purity products, for example containing less than 0.010% sulphur, which at present requires that use may be made only of very pure scrap iron, very pure pre-reduced products, or desulphurised pig iron.

In current high-productivity methods, the oxidising and reducing refining are carried out in different places. The present method makes it possible to cause the two reactions to occur, mutually excluding each other, at the same place and successively.

It also enables steels to be produced with a much lower nitrogen content than steels produced according to conventional methods. Effectively, the two main sources of nitrogen pollution in the metallurgical treatment zone, the electric arc and the delayed melting of scrap iron, are avoided and the residual nitrogen content is reduced by bubbling a neutral gas, particularly argon, into the metallurgical treatment zone. In addition, denitrification is facilitated by the low sulphur content of the metallic bath.

For a charge of 100% scrap iron, for example, a conventional electric furnace will produce a steel with 70 to 80 ppm N, whereas with the present method steels with a nitrogen content of about 40 ppm or even lower can be produced.

According to a first preferred mode of execution, the reducing slag is evacuated from the metallurgical treatment zone before, during or after stage (g), i.e. the pouring of the liquid metal. It is in fact preferable to eliminate the sulphur-rich reducing slag before carrying out the refining of the new charge of molten metal in order, during the refining, to prevent the sulphur contained in the slag from passing once again into the bath of molten metal.

Under certain conditions, for example when there is too much slag in the melting zone or when a larger quantity of slag is needed in the metallurgical treatment zone, it may be advantageous to transfer some oxidising slag contained in the melting zone to the metallurgical treatment zone before, during or after refining the molten products in the metallurgical treatment zone.

The converse, i.e. the transfer of oxidising slag from the metallurgical treatment zone to the melting zone during or after refining the products melted in the metallurgical treatment zone may be of interest. In fact, in the metallurgical treatment zone, the slag is foaming and contains a lot of iron oxides and drops of metallic iron. During the transit of the slag through the melting zone, the slag is deoxidised on contact with the molten metal with a higher carbon content, and drops of metal are decanted there. A counter-current exchange of mass is achieved in this way, which enables the loss of iron to be minimized.

Moreover, in an arc furnace, the foaming slag formed, which is transferred to the melting zone, has the effect of stabilising the electric arc and increasing its efficiency.

At certain times during the method—for example during the pouring of the metal and/or during the desulphurisation of the metal—it may be an advantage to stop the transfer of melted products to the metallurgical treatment zone completely or to reduce it considerably.

Depending on the composition of the raw materials, it may be an advantage to carry out a pre-refining of the molten products in the melting zone.

In a preferred mode of execution, the gases released during the refining of the molten products are transferred to the melting zone in order to heat the solid products occurring in this zone. In fact, the refining of the bath of steel is accompanied by the formation of abundant quantities of CO (nearly half the CO released by the method is produced during refining). The energy contained in this CO gas may be used to heat the solid products in the melting zone and the solid products in any possible pre-heater of the solid products either using counter-current contact or partial co-current contact. The energy contained in the hot gases may also be recovered to increase the energy efficiency of the reactor.

In another preferred mode of execution, the melting zone is continuously charged with solid products. With the melting zone being continuously charged with solid products, the melting zone permanently contains solid products and the energy efficiency of the melting zone may be maximised.

The solid products are advantageously preheated before loading using hot gases from the reactor. In this way, the gases released during the melting and the refining may be recovered to increase the temperature of the solid products before they are loaded into the furnace. The solid products therefore reach their melting point more quickly and the melting time is substantially shortened. This leads to an increase in the overall thermal efficiency of the reactor, and possibly in its productivity. The preheating is carried out, for example, in a pre-heater which may take the form of a vertical or inclined hopper extending the melting zone or the form of an inclined rotating drum.

It should be noted that the solid products may be heated and/or melted either using an electric arc or using gas-, oil-, or coal-burners or using a combination of these various methods.

Apart from the advantages described above, the method of the present invention has other advantages in comparison with conventional methods of melting. In fact, since the melting zone may function continuously and since discontinuous pouring is carried out from the metallurgical treatment zone, the periods when power is off caused by the chargings and pourings in conventional furnaces are eliminated and the reduction in power usable in the final period of so-called refining and superheating is no longer necessary.

Other special features and characteristics of the invention will emerge from the detailed description of a few advantageous modes of execution given below, for the purposes of illustration, in which reference is made to the appended drawings. The latter show:

FIG. 1: a longitudinal cross-section of an electric furnace for the continuous melting of solid products during the stage of melting/refining superheating.

Figure 2:
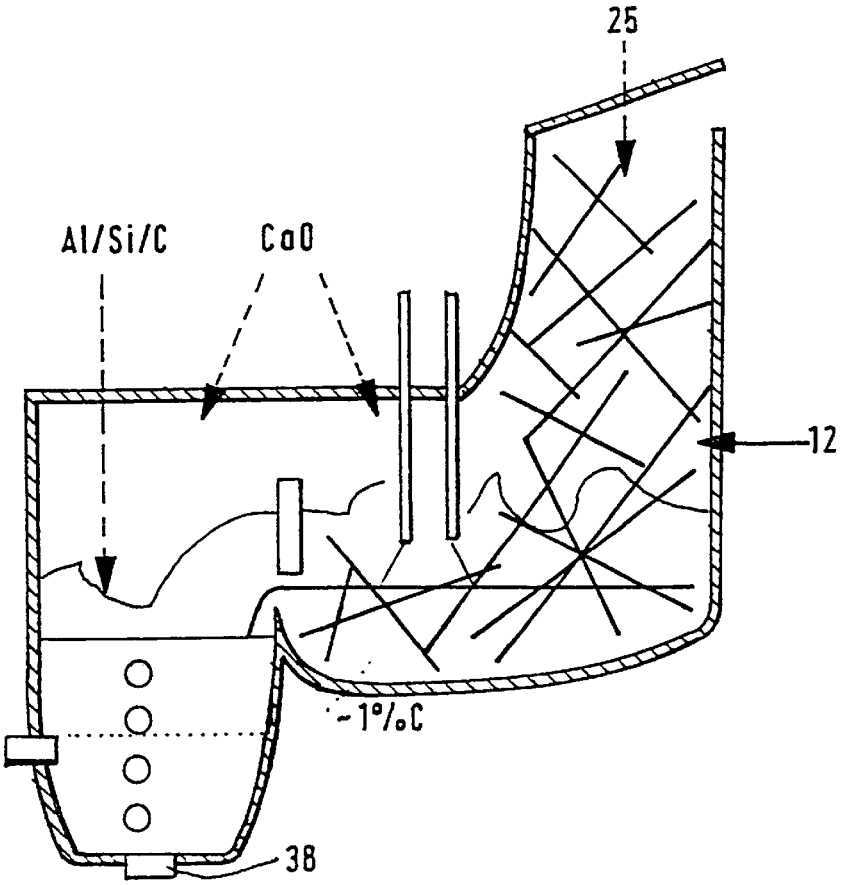

FIG. 2: a longitudinal cross-section of an electric furnace for the continuous melting of solid products during the stage of melting/slag reduction and desulphurisation of the steel.

Figure 3:
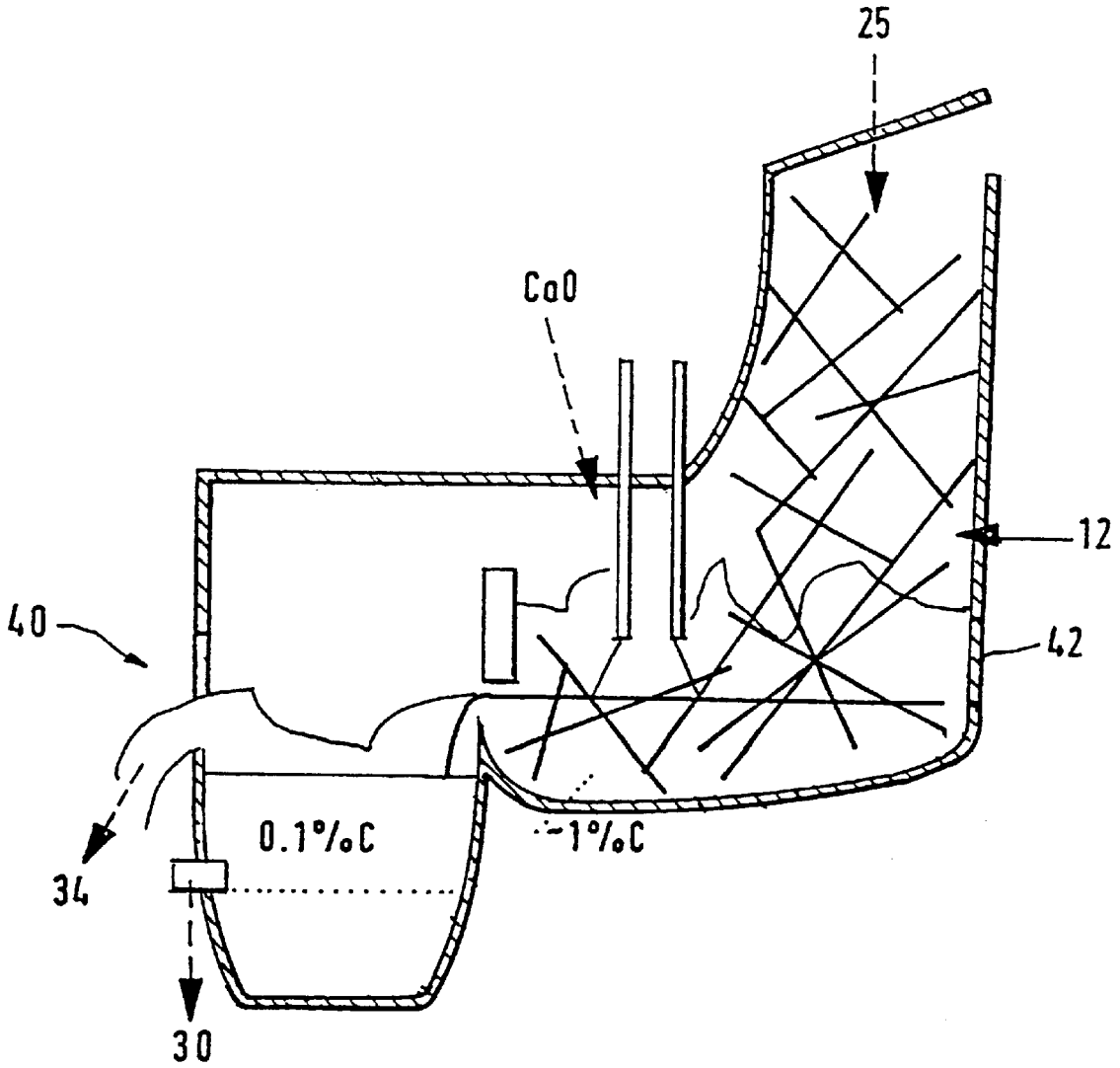

FIG. 3: a longitudinal cross-section of an electric furnace for the continuous melting of solid products during the stage of pouring and clearing out of the sulphur-rich slag.

FIG. 1 shows a cross-section of a reactor 10 for the continuous melting of solid products, such as solid iron, solid pig iron, scrap iron or scrap pig iron, pre-reduced products (DRI) etc., which are used, for example, for the production of steel. The reactor 10 takes the form of an electric furnace, in which the energy required for the melting is produced by an electric arc and by burners 12 mounted in the lower lateral part of the furnace 10.

The electric furnace 10 comprises a hearth 14 made of a refractory material, surmounted by a tank 16 and a roof 18. At least one electrode 20 mounted on a post (not represented) by means of an arm (not represented) is introduced into the furnace 10 through an opening 22 made in the roof 18. The arm may slide on the post so as to raise and lower the electrode 20.

The electric furnace 10 is sub-divided into two separate zones. The first zone, called the melting zone 24, is loaded, preferably continuously, with scrap iron 25 by means of a vertical hopper 26 positioned above the melting zone 24. In this melting zone 24, the scrap iron 25 is melted using the electrodes 20 passing through the roof 18 of the furnace 10. To increase the speed with which the scrap iron 25 is melted, additional energy is provided by means of burners 12 in the side wall of the furnace 10.

Even when the main source of energy is an electric arc, an addition of 10 to 20 kg of carbon per tonne of steel produced is advantageously brought into the melting zone. This carbon is added either in the form of coke or anthracite or in the form of carburised metal, for example pig iron. About half of this carbon is eliminated by the injection of oxygen through immersed lances or tuyeres so that the molten metal transferred to the metallurgical treatment zone has an intermediate carbon content of the order of 0.5 to 1%. Because of the injection of oxygen, there is an oxidising slag present, which enables a large part of the phosphorus to be eliminated from the melting zone.

As the scrap iron 25 progressively melts, molten metal accumulates in the hearth 14 of the melting zone 24 and when this has reached a certain level it flows over a sill 27 into the second zone of the furnace called the metallurgical treatment zone 28.

In the first stage of the method, the molten metal in the treatment zone undergoes conventional refining operations by the injection of gases such as oxygen through a lance 32 in order to adjust the chemical composition of the molten metal. During such refining operations, the carbon content of the steel may be reduced from about 1% by weight down to about 0.1%.

The hot gases released during the refining of the molten products are transferred to the melting zone 24 and are then drawn in by the hopper 26 supplying the furnace 10 with scrap iron 25. A large part of the energy contained in these gases can be used to heat the scrap iron 25 in the melting zone 24 as well as the solid products contained in the pre-heating hopper 26. This system is very similar to a counter-current heat exchanger, which has an optimum thermal efficiency.

Lime (CaO) is added to the melting zone and the metallurgical treatment zone in order to form a slag there. Various additives like fluxing agents for example may also be added to it.

In the metallurgical treatment zone 28 the slag is foaming 34 and contains large quantities of iron oxides and drops of metallic iron during the refining stage.

The slag contained in the two zones is separated by a slag barrier 36, possibly removable, installed between the two zones at the position of the sill 27. This barrier prevents slag from passing from the melting zone 24 into the metallurgical treatment zone 28.

The fact that the slag in the two zones is separated is particularly important in the second stage of the method, the desulphurisation stage. During the refining and superheating stage, the slag contained in the melting zone 24 and that contained in the metallurgical treatment zone 28 have similar chemical properties, i.e. the slags in both zones are oxidising slags. For this reason, it is unnecessary to separate them during this first stage. The barrier 36 may therefore be entirely or partially removed in order to allow an exchange of slag between these two zones. On the other hand, during the desulphurisation stage, the chemical properties of the slags contained in the melting zone and the metallurgical treatment zone are different and incompatible.

Whereas the chemical composition of the slag in the melting zone 24 remains unaffected, aluminium and/or silicon and possibly carbon are added to the metallurgical treatment zone 28 in order to convert the oxidising slag into a reducing slag. Of course, the oxygen lance 32 is stopped during this desulphurisation stage.

To guarantee adequate homogenisation of the bath of molten metal, a neutral gas (argon) is injected into the bath of molten steel through one or more porous blocks 38 through the bottom of the metallurgical treatment zone 28. The eddies created by this injection of gas improve the contact between the molten steel to be treated and the reducing slag so that desulphurisation takes place under the best conditions.

During this desulphurisation stage, the arrival of the molten metal from the melting zone 24 may be reduced or even completely stopped with the aim of limiting the quantity of unrefined metal in the metallurgical treatment zone 28 during desulphurisation.

FIG. 3 shows the last stage of the method, the pouring of the molten metal. After refining and desulphurisation, the sulphur-rich reducing slag is evacuated through the slag-clearing door 40 and the molten metal is poured from the metallurgical treatment zone 28 through a taphole 30 while retaining molten metal in the bottom of this zone. Such a condition at the bottom of the bath serves to reduce wear on the refractory lining. It should be noted that the taphole 30 may equally well be made in the side wall of the metallurgical treatment zone 28 as in the bottom of this zone.

It is advantageous to remove most of the reducing slag at the end of the desulphurisation stage and in any case before the next refining in order to prevent the sulphur contained in the reducing slag from once again passing into the molten steel when the next charge is being refined.

Although, in the reactor described above, the metallurgical treatment zone 28 operates in discontinuous mode, it should be noted that the melting zone 24 operates continuously. The periods when power is off caused by the charging and pouring processes in conventional furnaces are therefore eliminated and the reduction in power usable in the final period of so-called refining and superheating is no longer necessary.

The fluxes of material and the fluxes of energy in the furnace may be summarised as follows: some scrap iron 25 is introduced into the furnace through the hopper 26, it passes through the melting zone 24 to be subsequently drawn off by the metallurgical treatment zone 28.

The gas flux traverses the furnace in the opposite direction. In fact, the gases are injected or formed in the metallurgical treatment zone 28 and the melting zone 24 to be drawn up through the hopper 26.

The slag contained or formed in the metallurgical treatment zone 28 is evacuated through the slag-clearing door 40 located in this zone while the slag contained in the melting zone 24 may be evacuated through the slag-clearing door 42 located in the melting zone 24.

The efficiency of the method is illustrated with the help of two examples as follows.

In the first example, the efficiency with which the sulphur and phosphorus are eliminated for a charge of ordinary scrap iron in a conventional electric furnace is compared with that in a two-zone furnace using the method according to the present invention. In both cases, a quantity of 100 kg of slag per tonne of steel is considered.

In the conventional furnace, the slag is highly oxidising and contains <0.1% by weight of carbon and about 25% by weight of FeO. The partition coefficient for sulphur, i.e. the ratio between the sulphur content in the slag and the sulphur content in the metal, is less than 5 and that for phosphorus is about 50. An elimination of 70% to 80% of the phosphorus contained initially in the metal and about 25% to 30% of the sulphur is therefore achieved. The conventional furnace thus makes it possible to obtain, from scrap iron, steels with a very low concentration of phosphorus but with a significant concentration of sulphur. In the method according to the present invention, a moderately oxidising slag containing less than 10% by weight of FeO and with a basicity of about 2.5 is formed in the melting zone. The partition coefficient under such conditions is 5 to 10 for sulphur and about 25 for phosphorus. Assuming that 32 kg of CaO are used to form 80 kg of slag per tonne of steel in the melting zone, the elimination of between 30% and 40% of sulphur and between 60% and 70% of phosphorus is achieved inside the melting zone.

The metal with these reduced concentrations of sulphur and phosphorus is then transferred to the metallurgical treatment zone. In this zone, 20 kg of slag per tonne of steel are formed by adding 12 kg of CaO per tonne of steel and possibly fluxing agents.

After the oxidising refining, the slag is rendered reducing by adding either aluminium or silicon and/or carbon. The FeO content of the slag is reduced to zero and the basicity of the resultant slag is about 3. The metallurgical treatment zone is subjected to vigorous stirring by the argon. When aluminium is used, the partition coefficient for sulphur is of the order of 500 while it is only about 100 when the slag is deoxidised by silicon. Under the aforesaid conditions and by using aluminium to kill the slag, an elimination of between 80% and 90% of the sulphur contained in the steel supplied to the metallurgical treatment zone is achieved. When silicon is used to deoxidise the slag, between 60% and 70% of the sulphur contained in the steel supplied to the metallurgical treatment zone is eliminated.

The overall reduction in sulphur content for 100 kg of slag per tonne of steel is therefore 86% by weight when aluminium is used and 72% when silicon is used. The overall reduction in phosphorus content is 60% by weight.

The present method therefore makes it possible to obtain much lower sulphur contents than in conventional methods while achieving comparable performances as regards phosphorus.

The same analysis may be carried out for a metallic charge incorporating a large proportion of pre-reduced products or of non-desulphurised pig iron; such a charge is used to produce high quality finished products requiring low copper and sulphur contents.

The table below recapitulates the metallurgical performances of a conventional melting method and those of a melting method according to the present invention.

In the case of the production of rods for reinforced concrete from scrap iron, it can be seen that the method according to the present invention makes it possible to avoid an additional step of desulphurisation in a ladle.

When producing wire for wire-drawing, the present method makes it possible either to use cheaper raw materials or, when using the same raw materials, to do without a second desulphurisation step.

TABLE 1

Comparison between the performances of a conventioanl melting method and those using the method according to the present invention.

| Finished product | Charge | Metal yield | Quantity of slag | Method | Analysis of furnace pouring % Cu | % S | ppm N | Comments |
|---|---|---|---|---|---|---|---|---|
| Rods for reinforced concrete <0.5% Cu <0.03% S (slag killed by Al) | 100% scrap iron with 0.4% Cu | 0.90 | 100 | Conventional | 0.44 | 0.047 | 80* | additional desulphurisation required |
| | 0.06% S | | | according to the present invention | 0.44 | <0.01 | ≦40* | acceptable analysis for continuous casting |
| Wire for fine wire-drawing <0.2% Cu <0.01% S <70 ppm N (slag killed by Si) | 50% scrap iron with 0.3% Cu 0.06% S + 50% DRI with 0% Cu or 50% pig iron with 0% Cu 0.06% S | 0.87 | 150 | Conventional | 0.17 | 0.046 | 50* | two additional desulphurisation steps or use of purer scrap iron |
| | | | | according to the present invention | 0.17 | 0.014 | 40* | additional desulphurisation enabling the objective to be reached easily |

*about 20 ppm N is assumed to be taken up again between the end of refining in the furnace and the continuous casting.

What is claimed is:

1. Method for the continuous melting of solid metallic products in a reactor with two separate zones, the reactor comprising a melting zone and a metallurgical treatment zone, in which in the melting zone the solid metallic products are continuously heated until said metallic products are smelting and the melted products so obtained are progressively transferred into the metallurgical treatment zone, said method comprising, in a same receptacle of the metallurgical treatment zone, a succession of steps which include a) refining the melted products in an environment comprising an oxidizing slag, b) separating the slag of the metallurgical treatment zone from slag of the melting zone, c) converting said oxidizing slag into a reducing slag, d) desulfurizing the melted products in an environment comprising a reducing slag, e) pouring said melted products.

2. Method according to claim 1, further comprising the evacuation of the reducing slag from the metallurgical treatment zone before, during or after step (e).

3. Method according to claim 1, further comprising the transfer of the oxidizing slag from the melting zone to the metallurgical treatment zone before, during or after step (a).

4. Method according to claim 1, further comprising the transfer of the oxidizing slag from the metallurgical treatment zone to the melting zone before, during or after step (a).

5. Method according to claim 1, further comprising the interruption of the transfer of melted products to the metallurgical treatment zone during step (d).

6. Method according to claim 1, further comprising a pre-refining of the melted products in the melting zone.

7. Method according to claim 1, wherein gases released in the metallurgical treatment zone during the refining of the melted products are transferred to the melting zone in order to heat up the solid products present in this zone.

8. Method according to claim 1, wherein the melting zone is charged continuously with solid products.

9. Method according to claim 1, further comprising a charging of liquid pig iron into the reactor.

10. Method according to claim 1, wherein, before their charging, the solid products are pre-heated using hot gases from the reactor.

11. Method according to claim 1, wherein the solid products are heated by means of an electric arc and/or burners and/or plasma torches.

12. Method according to claim 1, further comprising a supply of energy to the metallurgical treatment zone during the initial stage of the method.

13. Method according to claim 2, further comprising the interruption of the transfer of melted products to the metallurgical treatment zone during step (d).

14. Method according to claim 1 wherein step (c) includes an addition of one or more of additives aluminum Al, silicon Si and carbon C to the reducing slag.

15. Method according to claim 14 wherein the addition of one or more of said additives is carried out in a quantity which avoids an increase in concentration of said additives in the melted products in said metallurgical treatment zone.

16. Method according to claim 14 wherein step (d) includes stirring the melted products in said metallurgical treatment zone.

17. Method according to claim 16 wherein stirring the melted products includes bubbling an inert gas through the melted products in said metallurgical treatment zone.

18. Method according to claim 1 wherein stop (d) includes stirring the melted products in said metallurgical treatment zone.

19. Method according to claim 18 wherein stirring the melted products includes bubbling an inert gas through the melted products in said metallurgical treatment zone.

* * * * *

UNITED STATES PATENT AND TRADEMARK OFFICE

CERTIFICATE OF CORRECTION

PATENT NO. : 6,314,123 B1 
DATED : November 6, 2001
INVENTOR(S) : Wilhelm Burgmann et al.

It is certified that error appears in the above-identified patent and that said Letters Patent is hereby corrected as shown below:

Title page,
Item [30], Foreign Application Priority Data: please change "(DE)" to -- (LU) --

Signed and Sealed this

Ninth Day of July, 2002

*Attest:*

JAMES E. ROGAN
*Director of the United States Patent and Trademark Office*

*Attesting Officer*